US005696340A

United States Patent [19]

Ragni

[11] Patent Number: 5,696,340

[45] Date of Patent: Dec. 9, 1997

[54] KEYBOARDS FOR ELECTRONIC PIANOS

[76] Inventor: Lino Ragni, 8, Via Offagna, IT 62019 Recanati (MC), Italy

[21] Appl. No.: 603,074

[22] Filed: Feb. 20, 1996

[30] Foreign Application Priority Data

Feb. 20, 1995 [IT] Italy ..... RM950031 U

[51] Int. Cl.[6] ..... G10C 3/12

[52] U.S. Cl. ..... 84/423 R; 84/433; 84/439; 84/440; 84/441

[58] Field of Search ..... 84/423 R, 433, 84/439, 440, 441, 437

[56] References Cited

U.S. PATENT DOCUMENTS

| | | | |
|---|---|---|---|
| 637,069 | 11/1899 | Bell | 84/243 |
| 4,901,614 | 2/1990 | Kumano et al. | 84/1.1 |
| 5,062,342 | 11/1991 | Nagatsuma | 84/744 |
| 5,574,241 | 11/1996 | Kumano et al. | 84/439 |

*Primary Examiner*—Michael L. Gellner
*Assistant Examiner*—Shih-yung Hsieh
*Attorney, Agent, or Firm*—Laurence R. Brown

[57] ABSTRACT

Improvements to keyboards for electronic pianos and the like, wherein a support, preferably made of sheet metal, with a U-shaped section and a flat section and provided with a number of hammers equal to the number of keys, which hammers are made integral with the support by means of specific pivoting elements. These hammers are preferably made of metal and suitably shaped and balanced for actuation by the keys. An elastic escapement member is carried by the portion of the hammer making contact with the key typically by coated with a rubber element provided little step which, when the key is depressed and the thrust element inside the key comes into contact with the step, produces a slight release, similar to the feeling of escapement one perceives when playing a conventional piano.

4 Claims, 5 Drawing Sheets

KEYBOARDS FOR ELECTRONIC PIANOS

The object of this invention are improvements to electronic piano keyboards for obtaining a new keyboard very similar to that of a conventional piano, also in respect of the touch actually transmitted by the keys to the musician's fingers.

It is a well-known fact that electronic pianos are having a lot of success, since they may be used for making various kinds of music and in various kinds of performances, also thanks to the increasingly sophisticated electronics which make them extremely versatile.

One of the main problems of electronic keyboards is that of achieving a good balance between cost and performance, with regard to both the sounds produced and the "touch" of the keys while playing. In order to achieve good results, in fact, the electronic keyboard must be capable of transmitting a certain feeling to the musician's touch, the closest possible to the one produced by a conventional piano, Therefore, the keys must be balanced, they must not go down too easily when depressed, but at the same time they must not offer too much resistance, they must simply put the musician at his ease.

Another important element related to the characteristics of the keyboard is that in the presence of repeated and rapid use a key should not produce unwanted returns, which might modify the desired sound emission.

The object of this invention is a piano keyboard featuring a good balance between low cost and excellent performance, besides the other above mentioned characteristics.

This keyboard consists of a support made of sheet metal, or other suitable material, shaped in such a way as to be U-shaped at one end, then flat in the middle, and then L-shaped at the opposite end.

Externally to the U-shaped part there is a rubber-coated hook-shaped element, with which it is integral, which serves as a seat for the key.

Two strips of rubber and felt run parallel to the terminal sections of the U-shaped element, whilst another rubber and felt strip is found inside the U-shaped portion of the metal support, in the point hit by the hammer when not in action. These rubber and felt strips have the task of deadening and softening both the key-strokes and the return of the keys to their initial position.

The flat section of the support features slots at regular intervals, for introducing the specifically shaped hammers for pivoting the keys. At the pivot points of the hammers there is a pin, which is free to rotate inside a hole made in a support placed longitudinally and parallel to the edge of the slots. The hammers, preferably of metal, have a predetermined weight, are shaped and balanced at the pivot point so as to allow the full excursion of the key which, as stated above, is integral with them and, at the same time, so as to facilitate the return to their initial position, thus enabling the keys to move in such a manner as to transmit to the player a touch similar to that of a conventional piano.

The part of the hammer proceeding beyond the pivot is coated with a shaped rubber element featuring a small step, whose task it is to give the player the escapement feeling typical of conventional pianos, when the key is fully depressed.

There is another set of slots, smaller than the preceding ones and made along a longitudinal axis, parallel to the pivot supports, inside which are the contacts, coated with a soft rubber which, when depressed by the bracket on the underside of the keys make the electronic piano work, by means of the printed circuit. The soft-rubber elements which, as mentioned above, act as a contact with the printed circuit, also favour the key's return to its initial position.

At the end of the flat section of the metal support there are a rubber strip, contributing to the elastic return of the key to its initial position and the fastening ferrules for the keys, one for each key, with the pivots situated along a longitudinal line parallel to the rubber strip. The key fastening ferrules are provided with a tab which, by engaging the slot, besides ensuring the fastening of the key to the metal support, also enables the fast assembly and disassembly of the keys in the factory and the subsequent keyboard maintenance operations, A specific embodiment of the invention will now be described with reference to the accompanying drawings, in which:

Figure 1:
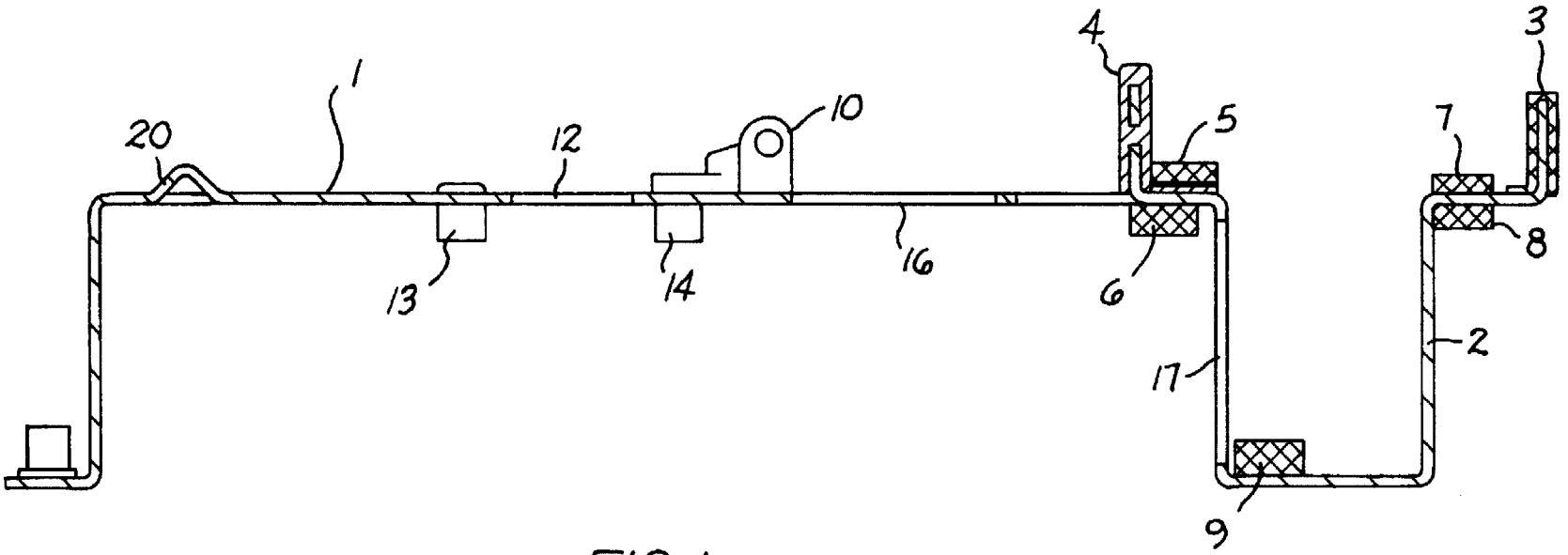
FIG. 1 shows a cross-section of the sheet metal support.
Figure 2:
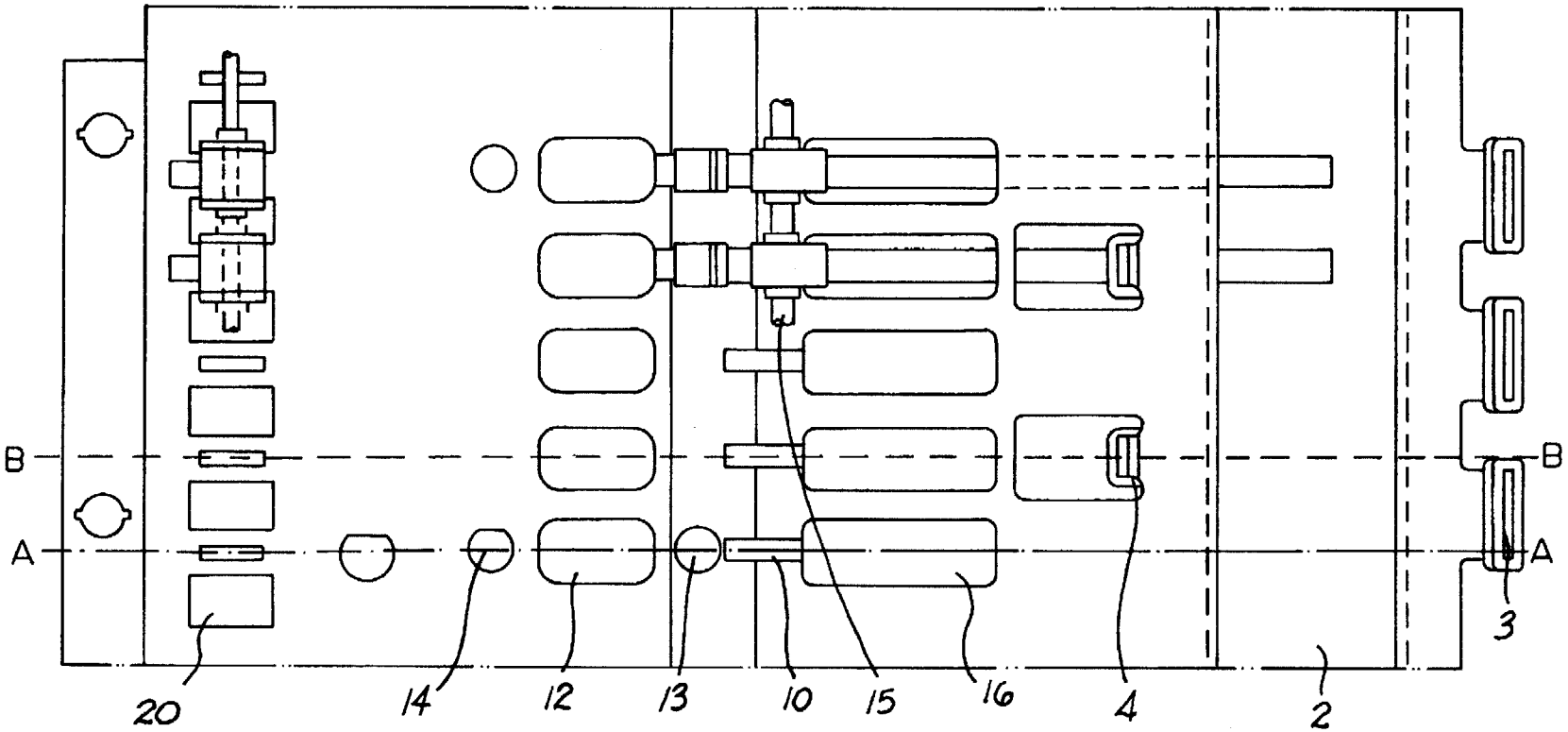
FIG. 2 shows a plan of a portion of the support mentioned in FIG. 1.
Figure 3:
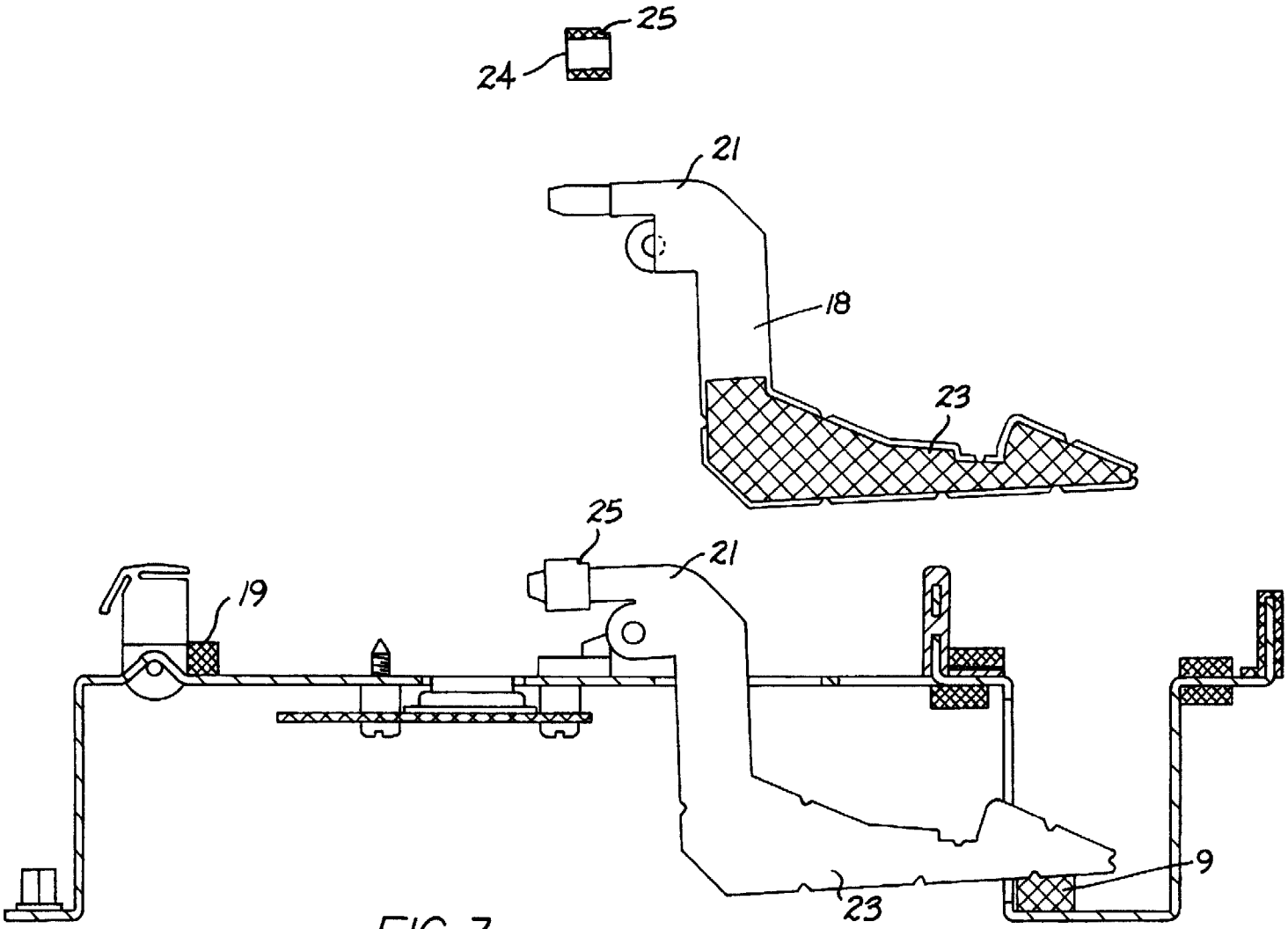
FIG. 3 shows a cross-section of the sheet metal support of the hammer and other details.
Figure 4:
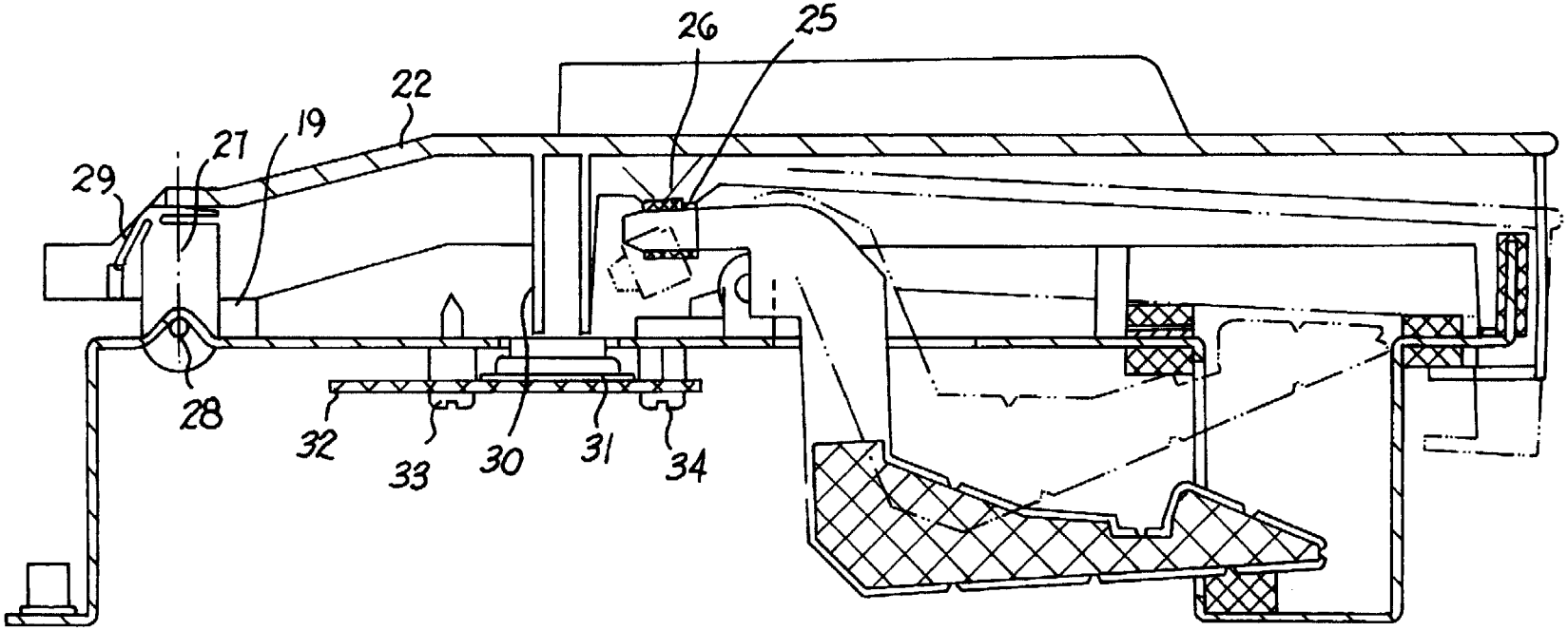
FIG. 4 shows a section of the keyboard, along the A—A line.
Figure 5:
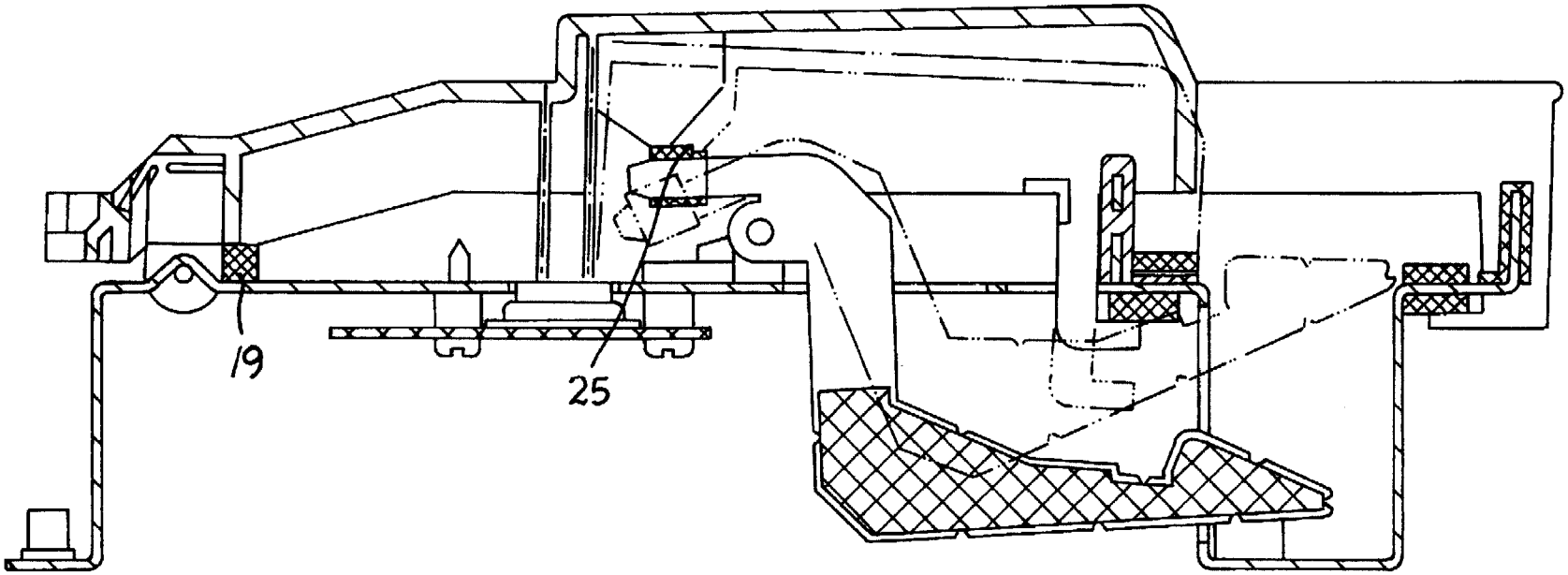
FIG. 5 shows a section of the keyboard, along the B—B line.

Referring to the above mentioned drawings and, in particular, to FIGS. 1 and 2, the electronic piano keyboard comprises a support (1), made of metal or other suitable material. The support (1) features an initial U-shaped section (2), in the proximity of which are fastened two vertical elements, a wider one (3), towards the outside, and a narrower one (4) towards the inside, both of which are coated in plastic, or similar material; the said elements (3) and (4) act as the end of stroke seat for the keys.

Near the seat elements (3) and (4), there are rubber and felt strips (5), (6), (7) and (8), placed on both sides of the support (1), while another rubber and felt strip (9) is placed inside the U-shaped part of the support (1), with the task of softening the end of stroke return of the keys.

The hammers (18) are inserted through the slots (16) and (17) made on the support (1) and supported by a perforated element (10) where they are pivoted by means of a cylinder-shaped pin (15). In the housing (12) there is the soft rubber-coated contact which, when pushed by the key, presses the printed circuit located on the underside of the support (1), at the housing (12), and made integral with the support (1) by means of screws or similar elements screwed on the elements (13) and (14). A rubber strip (19) is placed parallel to the element (20) which, thanks to a cylinder-shaped pin, forms the second pivot of the keys. The hammer (18) is fastened to the support (1), made of sheet metal or other suitable material, as mentioned above, by means of a cylinder-shaped pin introduced inside the hole made in the element (10). The hammer (18) is shaped so that the part (21) closest to the pivot allows the introduction of the key (22), while the part (23) passing through the slot (17) ends inside the U-shaped section (2) of the support (1) and, in particular, goes to rest on the rubber strip (9).

The part (21) of the hammer is enclosed in a rubber element (24), featuring a step (25); when the key pushes the rubber element (24), by means of the upside-down V-shaped seat (26), the step (25) enables the musician to feel a slight resistance, which becomes a light release, a feeling similar to that produced by conventional pianos, when a position of escapement is reached by fully depressing the key.

The attached drawings show that the key (22) is anchored to the metal sheet support (1) by means of the ferrule (27) with pivot in (28), enabling the controlled oscillation necessary to follow the key's movement; the ferrule (27) is provided with an elastic tab (29), which is inserted into the slot on the key and allows the fast assembly and disassembly of the key (22). When the key is depressed, a bracket (30) is thrust onto the contact (31) coated with a soft and elastic rubber, beneath which is the printed circuit which switches the contact, according to the programme. The printed circuit (32) is placed on the underside of the support (1), and is made integral with it by means of screws or the like (33) and (34), screwed onto the clamps (13) and (14).

As mentioned above, the homing of the key is secured by many elements complementing each other. The first is the hammer (18) which, being made of a heavy material, such as metal, for instance, and being perfectly balanced so that it always returns to its initial position when it is not in use, guides the key to its initial position as soon as it is released, but one cannot neglect the function of the rubber strip (19) and of the rubber coating of the contacts which, by means of the bracket (30), thrust the key upwards. When it is left, therefore, the key is subjected to an upward movement, exercised in three different points, while the downward end of stroke is deadened by the above mentioned rubber and felt strips (5), (6), (7), (8) and (9); all these devices help to make the touch of the keys similar to that of a conventional piano and, at the same time they prevent undesired returns, comparable to jumps, during the repeated and fast key-strokes, which, besides transmitting an unpleasant feeling may also modify the sound the musician wanted to obtain.

Obviously, the mechanism described herein is identical for all the keyboard keys, taking account, however, of the fact that the sharp key has an end of stroke seat (4) more toward the inside, compared to that (3) of the normal keys.

The description of this invention clearly shows that it makes it possible to prevent the above mentioned disadvantages enabling the realization of an especially reliable keyboard.

I claim:

1. Improvements to electronic musical instruments comprising in combination, keyboards, a mounting support for said keyboards with a U-shaped section extending from a flat section, a set of keys, a number of hammers equal to the number of keys, which hammers are mounted upon the support by pivoting elements and are suitably shaped and balanced and positioned to register with corresponding keys: a pivotable hammer element for making contact with its corresponding key carrying a rubber element having an escapement step arranged so that when the key is depressed and the key comes into contact with the step, the hammer element is pivoted to cause the key to engage the escapement step and produce a similar to the feeling of escapement one perceives when playing a conventional piano.

2. Improvements to electronic musical instruments, as claimed in claim 1, wherein the keys are fastened to the mounting support by means of a pivoted fastening ferrule and the keys have a slot for receiving an elastic tab on said ferrule thereby allowing the fast assembly and disassembly of the key.

3. Improvements to electronic musical instruments, as claimed in claim 2, further comprising a soft rubber strip positioned on said mounting support to intercept the keys and help the key to return to their initial position, when released.

4. Improvements to electronic instruments, as claimed in claim 1, wherein the hammers comprise a pivoting lever balanced to urge the hammer by gravity to a rest seat against an elastic strip, and the keys comprise a pivotable lever resting at a contact seat to elastically overcome an elastic strip for making contact with the hammer, whereby the elastic strips placed at the seats of the keys and hammers in rest position, thus soften the return stroke of the keys.

* * * * *